US010280535B2

(12) United States Patent
Gäbler

(10) Patent No.: US 10,280,535 B2
(45) Date of Patent: May 7, 2019

(54) ALL-STEEL CLOTHING FOR A CARDING MACHINE

(71) Applicant: TRUETZSCHLER GMBH & CO. KG, Moenchengladbach (DE)

(72) Inventor: Peter Gäbler, Ebhausen (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 178 days.

(21) Appl. No.: 15/301,950

(22) PCT Filed: Mar. 5, 2015

(86) PCT No.: PCT/EP2015/000498

§ 371 (c)(1),
(2) Date: Oct. 4, 2016

(87) PCT Pub. No.: WO2015/154837

PCT Pub. Date: Oct. 15, 2015

(65) Prior Publication Data

US 2017/0121863 A1 May 4, 2017

(30) Foreign Application Priority Data

Apr. 7, 2014 (DE) ..... 10 2014 104 883
May 20, 2014 (DE) ..... 10 2014 107 079

(51) Int. Cl.
*D01G 15/88* (2006.01)

(52) U.S. Cl.
CPC ..... *D01G 15/88* (2013.01)

(58) Field of Classification Search
CPC ..... D01G 15/88
(Continued)

(56) References Cited

U.S. PATENT DOCUMENTS 4,653,152 A * 3/1987 Wada ..... D01G 15/88 19/114
4,771,659 A 9/1988 Schmolke
(Continued)

FOREIGN PATENT DOCUMENTS

EP 1136599 A1 9/2001
FR 2821863 A1 9/2002
(Continued)

OTHER PUBLICATIONS

International Search Report for PCT/EP2015/000498, dated May 12, 2015, and English Translation thereof.
Written Opinion for PCT/EP2015/000498, dated May 12, 2015.

*Primary Examiner* — Shaun R Hurley
(74) *Attorney, Agent, or Firm* — Fisherbroyles, LLP; Robert Kinberg

(57) ABSTRACT

An all-steel clothing for a flat card or roller card for processing textile fibers includes a sawtooth wire having teeth arranged one after another in a wire running direction. The tooth contour of the teeth is defined, starting from a tooth base, as at least transitioning into a tooth back, further transitioning into a tooth tip portion, further transitioning into a tooth face and again transitioning into a subsequent tooth base. The tooth tip portion has a predetermined tooth tip length (L) in the wire running direction and a tooth prominence on top of a part of the tooth tip portion. The tooth prominence has a tooth prominence length (l) which is less than the tooth tip length (L).

9 Claims, 2 Drawing Sheets

(58) Field of Classification Search
USPC ..... 19/114; D15/78
See application file for complete search history.

(56) References Cited

U.S. PATENT DOCUMENTS

| | | | | |
|---|---|---|---|---|
| 4,953,264 | A * | 9/1990 | Hollingsworth | D01G 15/88 19/114 |
| 5,581,848 | A * | 12/1996 | Egerer | D01G 15/88 19/113 |
| 6,523,226 | B2 | 2/2003 | Graf | |
| 6,874,203 | B2 | 4/2005 | Bauersachs | |
| 8,745,826 | B2 * | 6/2014 | Vangheluwe | D01G 15/88 19/114 |
| 2009/0158558 | A1 * | 6/2009 | Marz | D01G 15/88 19/114 |
| 2013/0042437 | A1 * | 2/2013 | Vangheluwe | D01G 15/88 19/114 |
| 2013/0133159 | A1 * | 5/2013 | Vangheluwe | D01G 15/88 19/114 |
| 2014/0259537 | A1 * | 9/2014 | Zhang | D01G 15/88 19/114 |
| 2014/0338154 | A1 * | 11/2014 | Zhang | D01G 15/88 19/99 |

FOREIGN PATENT DOCUMENTS

| | | | |
|---|---|---|---|
| WO | 2013/037711 | A1 | 3/2013 |
| WO | 2013/072136 | A1 | 5/2013 |

* cited by examiner

ALL-STEEL CLOTHING FOR A CARDING MACHINE

CROSS-REFERENCE TO RELATED APPLICATIONS

This application is a U.S. National Stage of International Patent Application No. PCT/EP2015/000498 filed Mar. 5, 2015, designating the U.S. and claiming benefit of German Patent Application No. 10 2014 104 883.0 filed Apr. 7, 2014, and German Patent Application No. 10 2014 107 079.8, filed May 20, 2014.

BACKGROUND OF THE INVENTION

The present invention relates to an all-steel clothing for a flat card or roller card for processing textile fibres, which has a sawtooth wire having teeth formed one after another in the wire running direction, the tooth contour of the teeth being defined, starting from a tooth base, as at least transitioning into a tooth back, further transitioning into a tooth tip portion, further transitioning into a tooth face and again transitioning into a subsequent tooth base, and the tooth tip portion being formed having a predetermined tooth tip length in the wire running direction.

An all-steel clothing of the same generic kind for a flat card or roller card is known from EP 1 576 215 B1. The sawtooth wire has teeth formed one after another in the wire running direction; a tooth tip portion referred to as a head surface is defined by a length which corresponds to at least 15% of the length of the tooth pitch; and the tooth pitch is defined as the spacing between the tooth tips of two adjacent teeth. The tooth tip of each tooth therein is formed by the transition from the tooth tip portion into the tooth face.

All-steel clothing should, on the one hand, have a long service life; on the other hand, the clothing should allow good orientation and cleaning of the textile fibres forming the yarns. For that purpose, the surface of the tooth tip portion, defined by the width of the teeth in the head region and the length of the tooth tip portions, should be as small as possible. If the surface is re-ground because of wear on the sawtooth wire, the surface of the tooth tip portion becomes larger, and consequently it is no longer possible to obtain a satisfactory carding result. This is especially due to the fact that, for construction of the teeth, and also especially for interacting with the textile fibres, the flank angle of the tooth back must be flatter than the face angle of the tooth face. If the surface area of the tooth tip portion is re-ground too often as a result of being ground down, the surface becomes larger owing to a reduction in the tooth height until the all-steel clothing can no longer be used.

SUMMARY OF THE INVENTION

The problem of the invention is to further develop an all-steel clothing having a sawtooth wire, wherein the teeth of the sawtooth wire should have a tooth contour which allows the tooth tip portions to be ground down as often as possible. The surface of the tooth tip portion therein should be made as small as possible and should not become unnecessarily larger even after being repeatedly ground down. In addition, the face angle of the tooth face should also, as far as possible, remain unchanged even after being repeatedly ground down.

The problem is solved starting from an all-steel clothing for a flat card or roller card for processing textile fibres according to the preamble of claim 1 in combination with the characterising features. Advantageous developments of the invention are mentioned in the dependent claims.

The invention includes the technical teaching that a tooth prominence is formed on the tooth tip portion, the tooth prominence having a tooth prominence length which is less than the tooth tip length.

The problem of the present invention is solved by a tooth prominence which is set on top of a part of the surface of the tooth tip portion. The tooth prominence in this case can be composed of the same material as, and constructed as one part with, the tooth itself, for example as a result of the tooth contour of the tooth being modified by the contour of the tooth prominence in the region of the tooth tip portion. If the tooth prominence is ground down, the tooth tip length does not change as a result, or only extremely slightly, because the tooth prominence does not make a transition into the tooth back at the rear. Rather, at the rear, the tooth prominence transitions into the tooth tip portion. The advantage is especially that the all-steel clothing can be re-ground up to six times or even more often. A further substantial advantage is that the face angle between the tooth face and the perpendicular to the wire running direction can have a value of from 50° to 60° and preferably of 55°. This angular value does not change even after repeated re-grinding of the all-steel clothing, and the all-steel clothing can be used with an optimum face angle even after repeated re-grinding.

Especially advantageously, the tooth prominence length can be from 10% to 50% and preferably from 15% to 25% of the tooth tip length. The tooth prominence can be provided on top of the tooth tip portion in the forward region so that the tooth prominence is formed on the tooth tip portion adjacent to the tooth face. This means that the tooth contour in the transition from the tooth prominence to the tooth face forms the tooth tip. When the sawtooth wire is re-ground and in the process the tooth prominence is made slightly lower with each grinding operation, the tooth tip moves in a downward direction as it is re-sharpened. For example, the sawtooth wire can be re-ground as often as is the case until the tooth prominence on the tooth tip portion has been completely ground down; before the sawtooth wire ceases to be used, the tooth tip is formed by a direct transition from the tooth tip portion into the tooth face. In the process, the face angle between the tooth face and the perpendicular to the wire running direction can maintain the value of, for example, 55°, until the sawtooth wire ceases to be used.

Further advantageously, the tooth prominence can be formed having a prominence top of planar construction. The tooth prominence can have a prominence back formed behind the prominence top, which prominence back is formed as part of the tooth contour approximately parallel to that portion of the tooth face which is located at the same height. If the contours of the prominence back and of the tooth face extend approximately parallel to one another, the length of the tooth prominence remains constant even after repeated re-grinding, and the tooth prominence length can stay, for example, from 10% to 50% and preferably from 15% to 25% of the tooth tip length. When the tooth prominence is correspondingly constructed, this value does not change and is maintained irrespective of the frequency with which the sawtooth wire has been re-ground.

The prominence top can be formed parallel to the wire running direction of the sawtooth wire, the wire running direction being defined by the course of the bottom side of the sawtooth wire, which when arranged on a cylinder, for example on the drum of a carding machine, can also have a curvature so that a corresponding tangent to the bottom side can be defined as the wire running direction. In accordance with a further advantage to the formation of the all-steel clothing, the face angle between the tooth face and the perpendicular to the wire running direction can have a value of from 50° to 60° and preferably of 55°. Accordingly, the prominence back can also have an angle that corresponds to the face angle.

Finally, the tooth prominence length can correspond to about from 10% to 20%, preferably from 12% to 18%, and especially 15%, of the length of the tooth pitch from tooth tip to tooth tip.

BRIEF DESCRIPTION OF THE DRAWINGS

Further measures which improve the invention are described in greater detail hereinbelow together with the description of a preferred example of an embodiment of the invention, referring to the Figures, wherein.

DETAILED DESCRIPTION OF THE INVENTION

Figure 1:
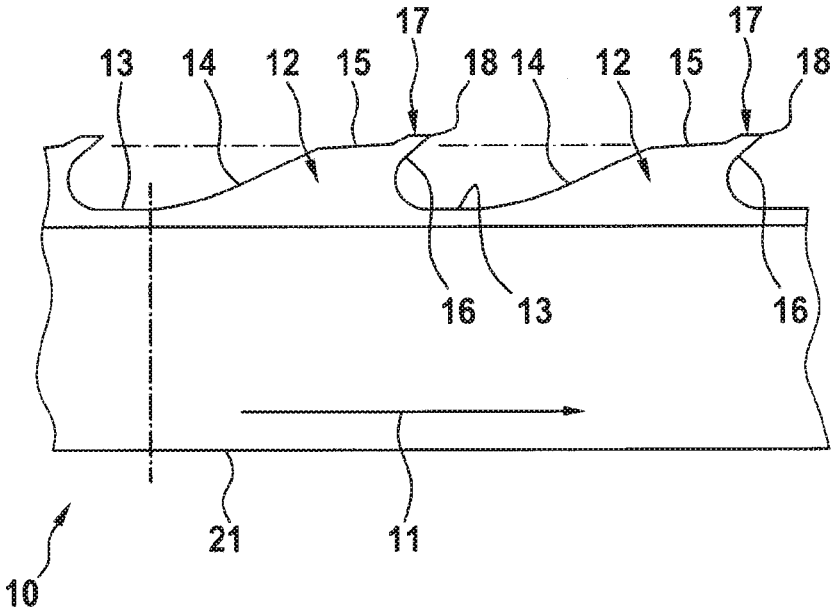
FIG. 1 shows a side view of a portion of the sawtooth wire having a tooth contour which has a tooth prominence on a tooth tip portion according to the invention.

FIG. 1 shows a portion of a sawtooth wire 10 of an all-steel clothing for a flat card or roller card for processing textile fibres. The sawtooth wire 10 has a wire running direction 11, which is defined by the course of the bottom side 21 of the sawtooth wire 10. In the portion of sawtooth wire 10 there are shown two teeth 12; the teeth 12 have tooth tips 18, which point in the wire running direction 11.

The tooth contour of the teeth 12 is defined by several portions; the tooth contour starts with a tooth base 13, which transitions into a tooth back 14; the tooth back 14 is located on that side of the tooth 12 which is opposite the wire running direction 11. Making a transition from the tooth back 14 there follows a tooth tip portion 15, which can extend parallel to the wire running direction 11 or the tooth tip portion 15 has a slope in the direction of the tooth back 14. The tooth tip portion 15 further transitions into a tooth prominence 17 according to the invention; and the tooth prominence 17 transitions into a tooth face 16 in the course of which it forms the tooth tip 18, the tooth face 16 facing in the direction of the wire running direction 11 and being extended by the height of the tooth prominence 17. Finally, the tooth face 16 again transitions into the subsequent tooth base 13.

Figure 2:
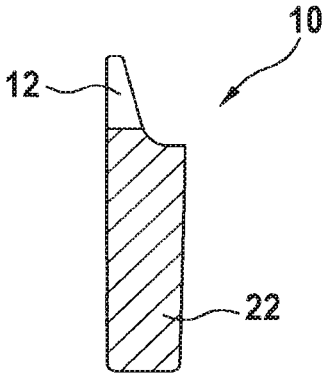
FIG. 2 shows a sectional view through the sawtooth wire.

FIG. 2 shows a side view of the sawtooth wire 10; the base portion 22 of the sawtooth wire 10 is of wider construction than the width of the tooth 12, which is adjacent to the top of the base portion 22. The cross-section, which is indicated in FIG. 1, lies between two teeth 12 and is delimited at the top by the tooth base 13.

Figure 3:
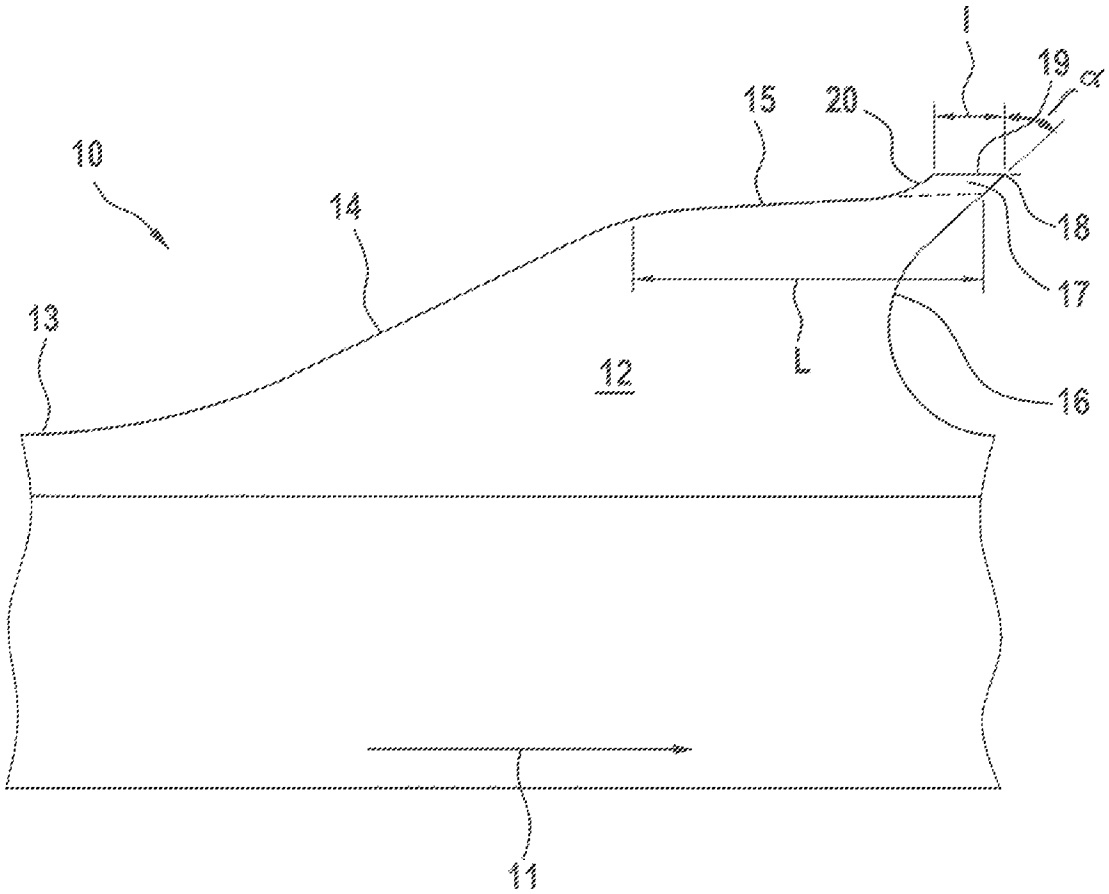
FIG. 3 shows a detailed view of a tooth of the sawtooth wire having the features according to the invention.

Finally, FIG. 3 shows a detailed view of a tooth 12 of the sawtooth wire 10, the tooth contour of the tooth 12 being shown in detail with the individual portions. Starting from the tooth base 13, the tooth back 14, which delimits the tooth 12 opposite to the wire running direction 11, follows on first. The tooth back 14 transitions into the tooth tip portion 15, which has a length L. At the front end of the tooth tip portion 15, which transitions into the tooth face 16, there is formed, on top of the tooth tip portion 15, a tooth prominence 17, and the tooth prominence 17 has the tooth prominence length l. The contour there transitions from the rear of the tooth tip portion 15 into a prominence back 20 and the prominence back 20 transitions into a prominence top 19. At the front of the tooth prominence 17, the contour of the tooth face 16 transitions into the prominence top 19, forming the tooth tip 18. The face angle α can be measured there between the tooth face 16 and the perpendicular to the wire running direction 11.

The view shows, approximately, the size relationships of the tooth prominence 17 to the tooth 12 and the view especially shows the tooth prominence length l, which is smaller than the tooth tip length L. For example, the tooth prominence length l can be from 10% to 50% and preferably from 15% to 25% of the tooth tip length L, the example showing that the tooth prominence length l is approximately 20% of the tooth tip length L.

If the sawtooth wire 10 is re-ground, re-grinding is carried out on the prominence top 19 of the tooth prominence 17. The sawtooth wire 10 herein can be repeatedly re-ground until the tooth prominence 17 on the tooth tip portion 15 has almost disappeared and the tooth tip portion 15 extends as far as the tooth tip 18 which has moved down into the region of the interrupted line, as shown in the Figure.

The invention is not limited in its execution to the preferred example of an embodiment described hereinbefore. Rather, many variants are feasible, which make use of the described solution even in the case of embodiments of fundamentally different form. All features and/or advantages, including structural details and spatial arrangements, arising out of the claims, description or drawings can be essential to the invention both on their own and also in the widest variety of combinations.

REFERENCE NUMERALS AND LETTERS

10 sawtooth wire
11 wire running direction
12 tooth
13 tooth base
14 tooth back
15 tooth tip portion
16 tooth face
17 tooth prominence
18 tooth tip
19 prominence top
20 prominence back
21 bottom side
22 base portion
α face angle
L tooth tip length
l tooth prominence length

The invention claimed is:

1. An all-steel clothing for a flat card or roller card for processing textile fibres, comprising:

a sawtooth wire having teeth formed one after another in a wire running direction, the teeth having a tooth contour defined, starting from a tooth base, as at least transitioning into a tooth back, further transitioning into a tooth tip portion, further transitioning into a tooth face and again transitioning into a subsequent tooth base, wherein the tooth tip portion has a predetermined tooth tip length (L) in the wire running direction, and a tooth prominence is set on top of a part of the tooth tip portion, the tooth prominence having a tooth prominence length (l) which is less than the tooth tip length (L) and corresponds to 10% to 20% of the length of the tooth pitch from tooth tip to tooth tip.

2. The all-steel clothing according to claim 1, wherein the tooth prominence length (l) is from 10% to 50% of the tooth tip length (L).

3. The all-steel clothing according to claim 1, wherein the tooth prominence is formed on the tooth tip portion adjacent to the tooth face so that the tooth contour in a transition from the tooth prominence to the tooth face forms a tooth tip.

4. The all-steel clothing according to claim 1, wherein the tooth prominence has a prominence top of planar construction.

5. The all-steel clothing according to claim 4, wherein the tooth prominence has a prominence back behind the prominence top that is part of the tooth contour approximately parallel to that portion of the tooth face which is located at a same height.

6. The all-steel clothing according to claim 4, wherein the prominence top is one of parallel to the wire running direction or has a slope of up to 3° relative to the wire running direction of the sawtooth wire, in which case the prominence top drops down in a direction of the prominence back as a result of the slope.

7. The all-steel clothing according to claim 1, wherein a face angle (a) between the tooth face and a perpendicular to the wire running direction has a value of from 50° to 60°.

8. The all-steel clothing according to claim 1, wherein the tooth prominence length (l) is from 15% to 25% of the tooth tip length (L).

9. The all-steel clothing according claim 1, wherein a face angle ($\alpha$) between the tooth face and a perpendicular to the wire running direction has a value of 50° to 60°.

* * * * *